US005173978A

United States Patent [19]

Kassai et al.

[11] Patent Number: 5,173,978

[45] Date of Patent: Dec. 29, 1992

[54] BED APPARATUS PROVIDED WITH BATHTUB

[75] Inventors: Kenzou Kassai; Hiroyasu Yamamoto, both of Osaka, Japan

[73] Assignee: Aprica Kassai Kabushikikaisha, Osaka, Japan

[21] Appl. No.: 788,205

[22] Filed: Nov. 5, 1991

[30] Foreign Application Priority Data

| | | | |
|---|---|---|---|
| Nov. 20, 1990 | [JP] | Japan | 2-317391 |
| Dec. 17, 1990 | [JP] | Japan | 2-402941 |
| Feb. 27, 1991 | [JP] | Japan | 3-32832 |

[51] Int. Cl.[5] ..... A61G 7/047; A61G 7/00; A61H 33/00

[52] U.S. Cl. ..... 5/600; 5/612; 5/928; 4/547; 4/585

[58] Field of Search ..... 5/600, 612, 606, 81.1, 5/83.1, 84.1, 18.1, 928; 4/585, 586, 587, 547, 546, 588, 564

[56] References Cited

U.S. PATENT DOCUMENTS

| | | | |
|---|---|---|---|
| 1,404,207 | 1/1922 | Lenz | 5/617 |
| 1,444,487 | 2/1923 | Volters | 4/587 |
| 2,095,997 | 10/1937 | Martin | 5/18.1 |
| 2,151,257 | 3/1939 | Wuest et al. | 5/18.1 |
| 3,701,170 | 10/1972 | Bond | 5/81.1 |
| 4,074,370 | 2/1978 | Harmony, III | 4/575.1 |
| 5,054,136 | 10/1991 | Inagaki | 5/606 |

FOREIGN PATENT DOCUMENTS

| | | | |
|---|---|---|---|
| 155303 | 11/1903 | Fed. Rep. of Germany . | |
| 969909 | 7/1958 | Fed. Rep. of Germany . | |
| 2215462 | 8/1990 | Japan | 5/81.1 |
| 2057864 | 4/1981 | United Kingdom | 4/564 |

*Primary Examiner*—Alexander Grosz
*Attorney, Agent, or Firm*—W. G. Fasse

[57] ABSTRACT

A bed apparatus (1) combines a bed body (3) and a collapsible bathtub (103). The bathtub (103) is vertically collapsible to be storable in a spaced under a bottom plate (106) of the bed body (3). The collapsible tub is movable by a guide member (104) between a position under the bottom plate (106) and a position on a side of the bottom plate (106). In an unused state, the bathtub (103) is stored in the space under the bed body in order to facilitate an effective use of a relatively narrow room.

10 Claims, 17 Drawing Sheets

BED APPARATUS PROVIDED WITH BATHTUB

FIELD OF THE INVENTION

The present invention relates to a bed apparatus which is suitable for nursing a sick person, a physically handicapped person or a bed-ridden old person (hereinafter simply referred to as "Sick person or the like"), for example, and more particularly, it relates to a bed apparatus which is combined with a bathtub.

BACKGROUND INFORMATION

A bed for a sick person or the like is generally provided with a function or an apparatus which is of use for the sick person or the like or for a nurse. For example, a certain type of such a bed is provided with an apparatus for helping defication by the sick person or the like, or a raising mechanism for enabling the sick person or the like to sit up.

In order to bathe the sick person or the like, on the other hand, the nurse must generally take the sick person or the like to a bathroom, which is separated from the bed. Due to such a heavy burden of the nurse, the sick person or the like cannot frequently take a bath under such circumstances.

Although there has been proposed a movable bathtub for a sick person or the like, such a movable bathtub is as large as the bed itself. Even if the bathtub is rendered collapsible, a relatively wide space is required for storing the same in an unused state.

The aforementioned problem is aggravated when the sick person or the like is nursed in the home. Since an average home is restricted as to the number of nurses, equipment, etc. it is impossible to satisfactorily bathe the sick person. Considering housing circumstances in Japan, the bed for the sick person or the like is generally placed in a narrow room such as a 6-mat room (about $360\times270$ cm$^2$) or a 4.5-mat room (about $270\times270$ cm$^2$). Even if a movable bathtub is employed, such a narrow room is almost occupied by the bed and the bathtub with no allowance for other equipment, instruments, etc., and the nurse is extremely restricted in movement. Under such housing circumstances, further, it is not easy to store such a movable bathtub in another room when the same is not used.

SUMMARY OF THE INVENTION

Accordingly, it is an object of the present invention to provide a bed apparatus combined with a bathtub, which can solve the aforementioned problems.

The bed apparatus provided with a bathtub according to the present invention comprises a bed body, a bathtub and a guide member.

The bed body comprises a bottom plate forming a bed face, and leg portions for bringing the bottom plate from a floor face to a prescribed horizontal position vertically above said floor face thereby defining a sidewardly opening space between the bottom plate and the floor face.

The collapsible bathtub can be stored in the space defined between the bottom plate and the floor face.

The guide member couples the bed body with the bathtub, for guiding the bathtub while moving between a position under the bottom plate and a portion on a side thereof.

According to the present invention, the bathtub is preferably rendered collapsible in the vertical direction. In the collapsed state, the bathtub is brought into dimensions to be storable in the space between the bottom plate of the bed body and the floor face.

According to the present bed apparatus provided with a bathtub, the guide member locates the bathtub on a side of the bottom plate of the bed body for using the tub. When the bathtub is not used, on the other hand, the guide member stores the same in the space which is defined under the bottom plate of the bed body.

Thus, according to the present invention, the bathtub can be stored in the space defined under the bottom plate of the bed body when the same is not used. Since the space under the bottom plate of the bed body is essentially a dead space, it is possible to efficiently use a narrow room by storing the bathtub in such a dead space. Further, it is not necessary to prepare an extra space for storing the bathtub, which may be as large as the bed itself. Thus, the present bed apparatus provided with a bathtub can be used with no problem, particularly under the restricted housing circumstances in Japan.

According to the present invention, the bathtub can be readily positioned on a side of the bed body. Therefore, the sick person or the like can be easily brought into the bathtub. Thus, the burden of the nurse for bathing the sick person or the like is so reduced that it may be possible to frequently bathe the sick person or the like.

When the bathtub is rendered retractable in the vertical direction, the same can be stored in the space under the bottom plate of the bed body in an unused state, even if the space is relatively narrow in the vertical direction. Further, the bathtub can be sufficiently expanded in the vertical direction when the same is used. Therefore, it is possible to contain a sufficient volume of hot water in the bathtub, as well as to prevent overflow of the hot water during bathing.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
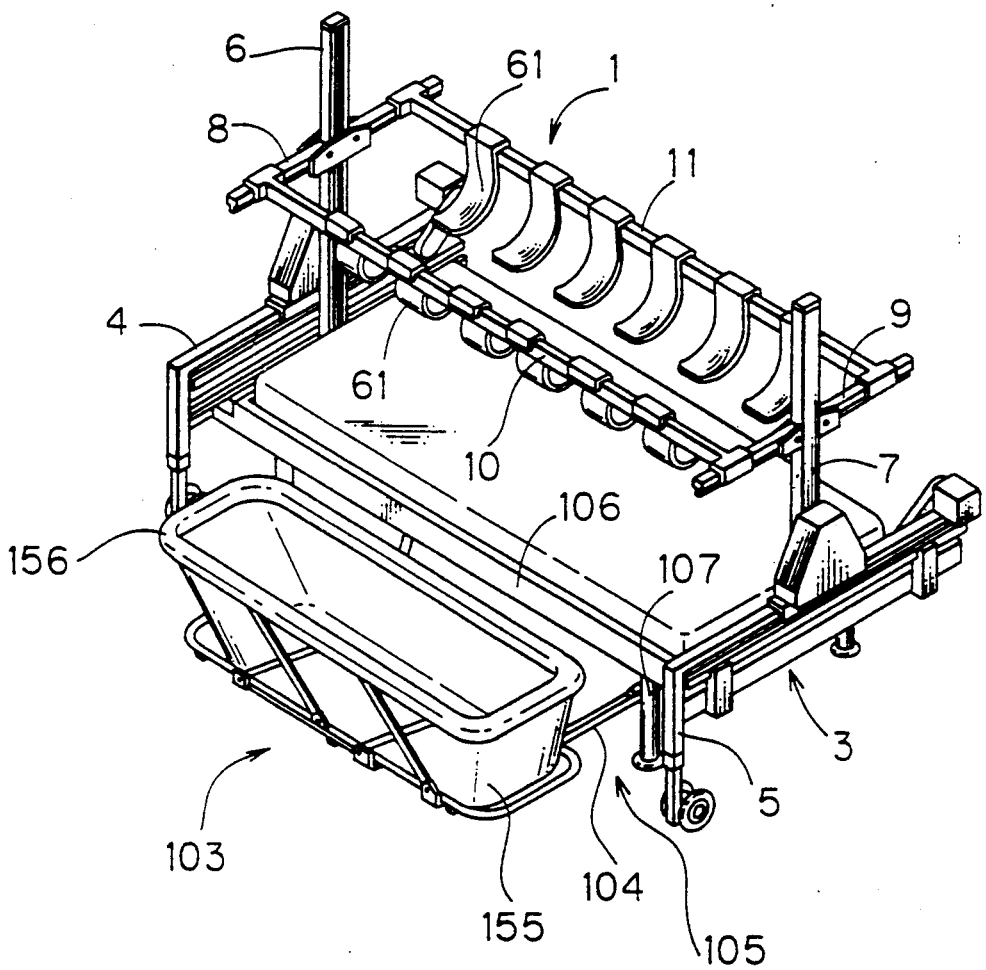
FIG. 1 is a perspective view showing the present bed apparatus provided with a bathtub, which is shown in a state ready for use.
Figure 2:
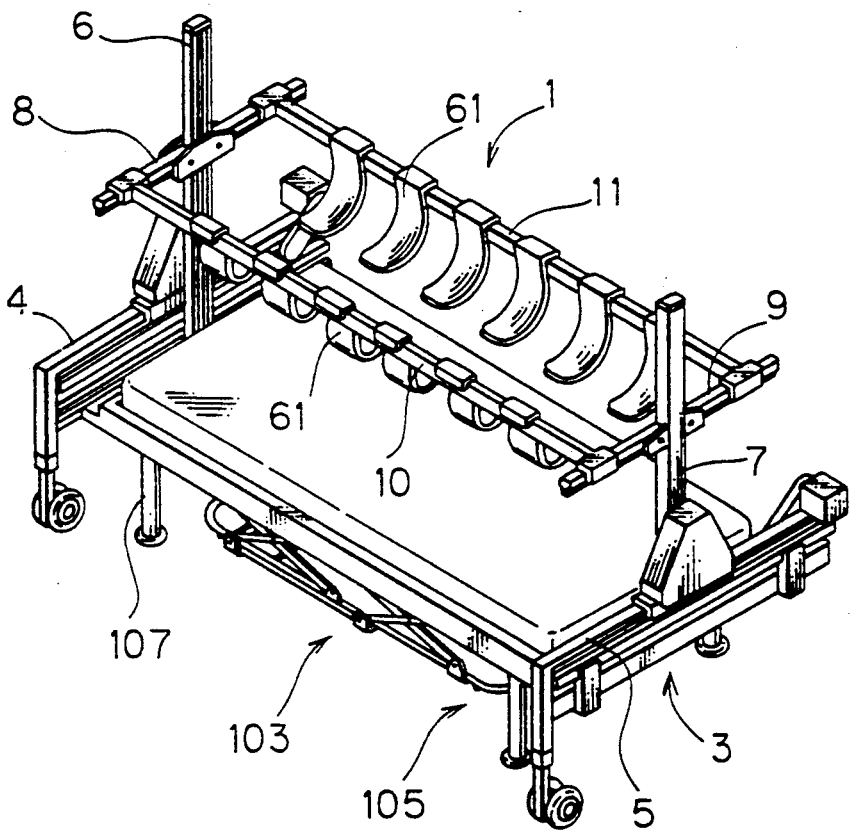
FIG. 2 is a perspective view showing the bed apparatus provided with a bathtub, which is shown in a stored state under the bed.

A bed apparatus 1 according to an embodiment of the present invention has a lifting mechanism as shown in FIGS. 1 and 2, for example, and comprises a collapsible bathtub 103. For convenience of illustration, the bed apparatus 1 having a lifting mechanism is first described independently of the bathtub 103, which is provided for cooperation with this bed apparatus 1.

FIGS. 3 to 21 are adapted to illustrate the bed apparatus 1 having a lifting mechanism in particular, with no illustration of the bathtub 103.

Figure 3:
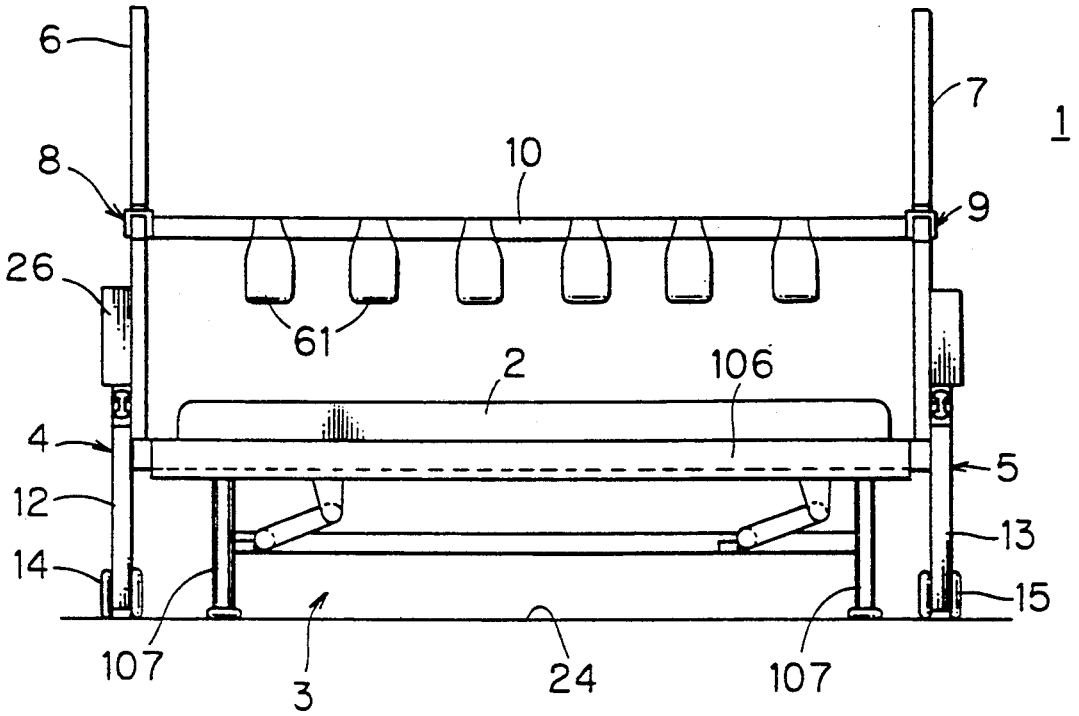
FIG. 3 is a front elevational view illustrating the bed apparatus shown in FIGS. 1 and 2, with no illustration of the bathtub.
Figure 4:
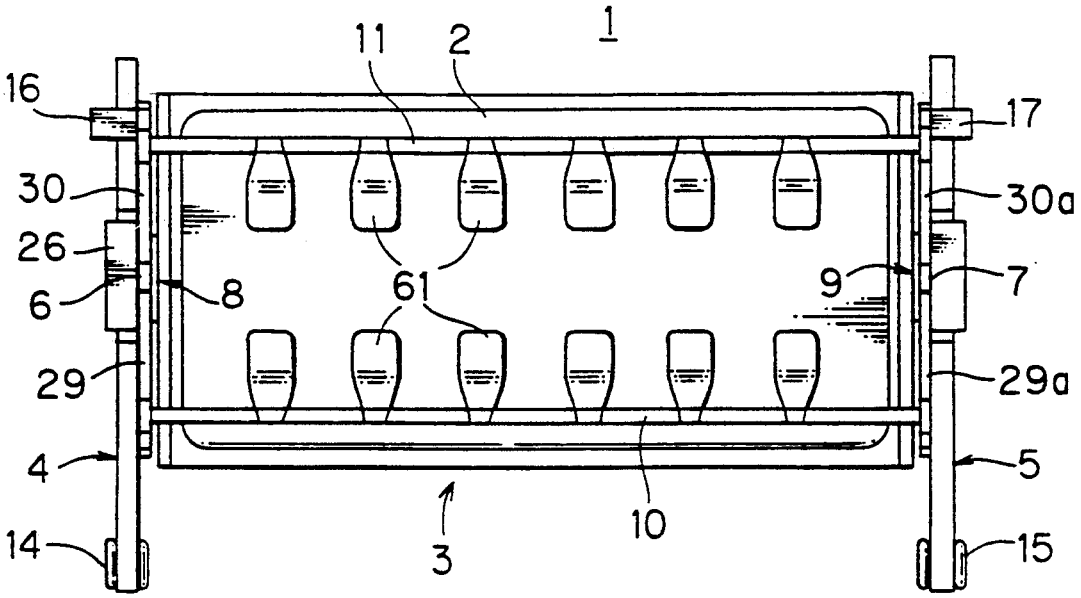
FIG. 4 is a plan view of the bed apparatus shown in FIG. 3.
Figure 5:
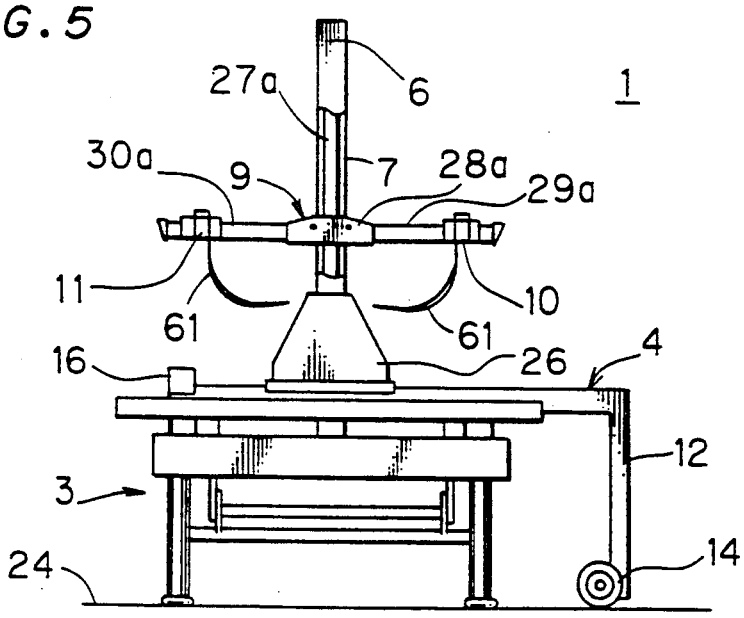
FIG. 5 is a left side elevational view of the bed apparatus shown in FIG. 3.
Figure 6:
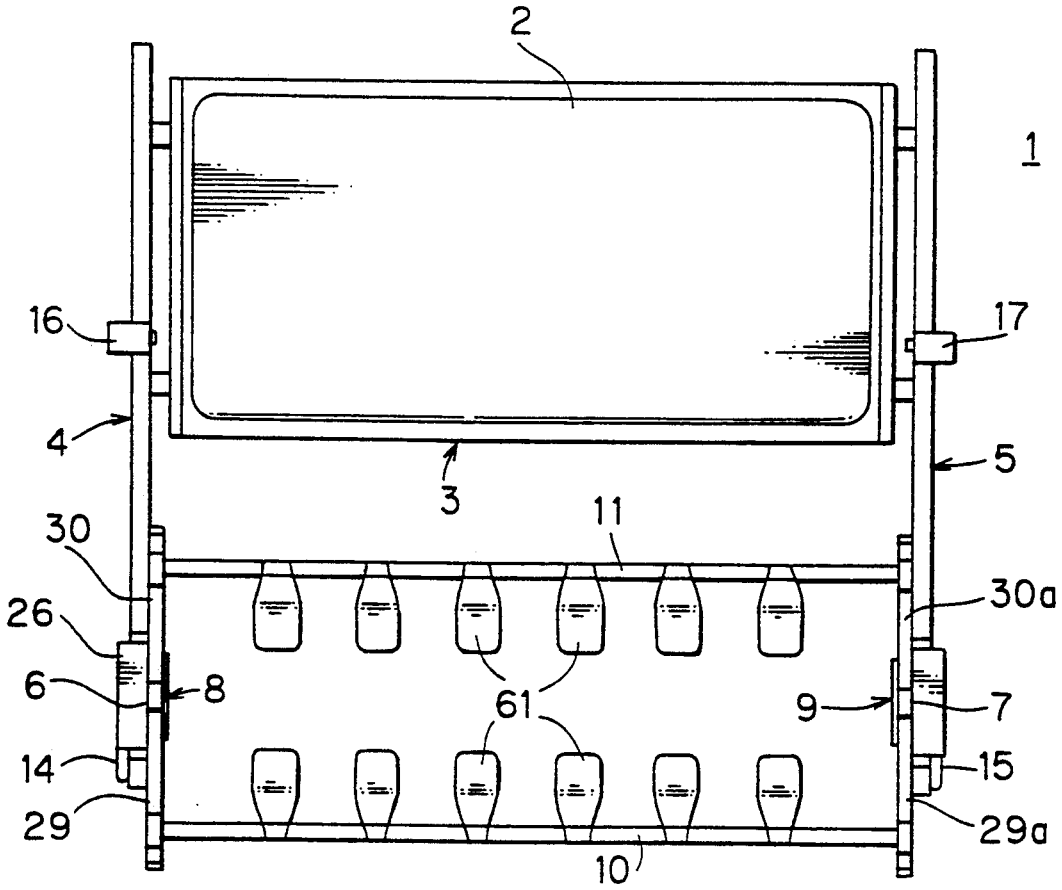
FIG. 6 is a plan view corresponding to FIG. 4, showing states of sliders, most extending from a bed body.
Figure 7:
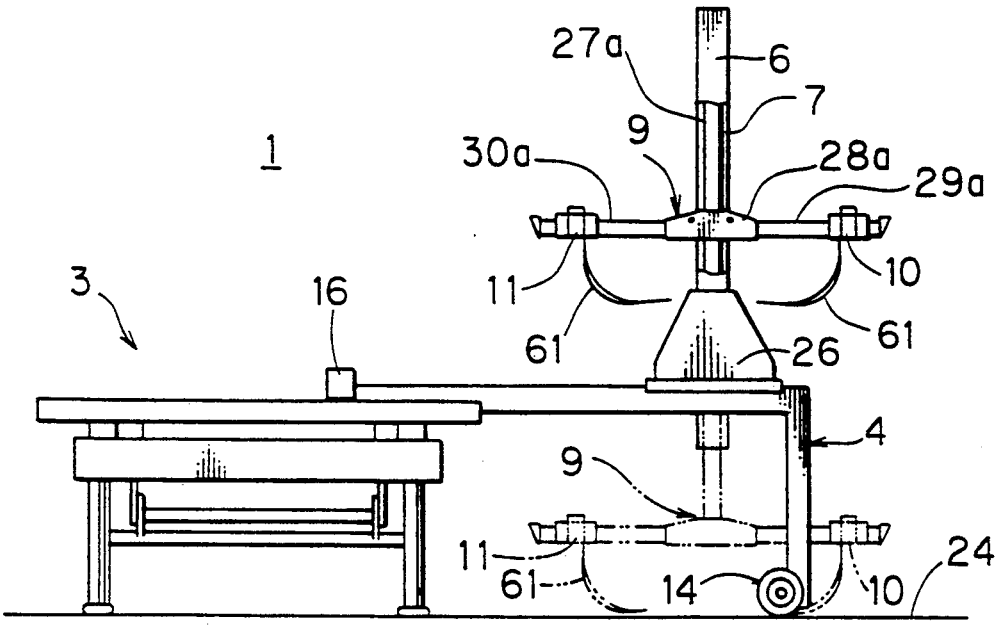
FIG. 7 is a left side elevational view corresponding to FIG. 5, showing the state shown in FIG. 6.
Figure 8:
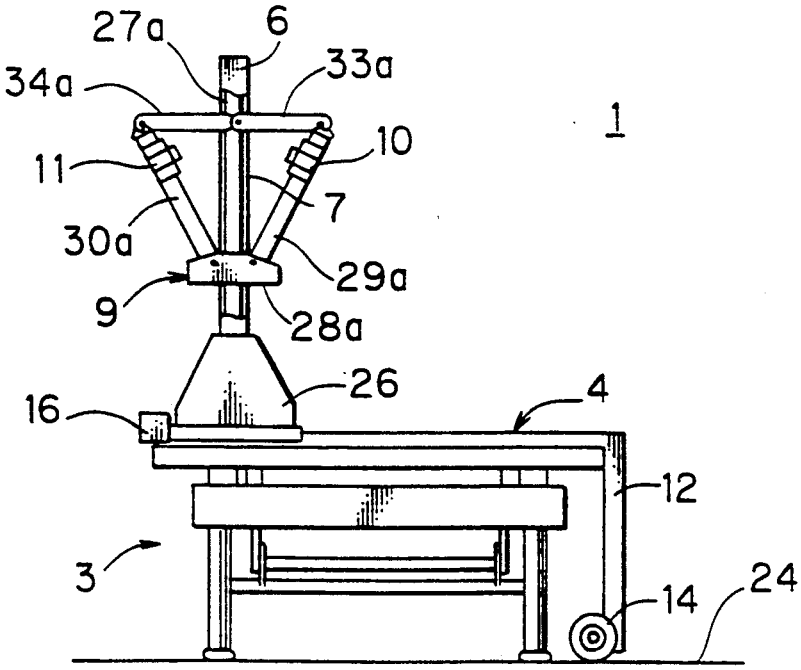
FIG. 8 is a left side elevational view corresponding to FIG. 5, showing states of the sliders, most retracted with respect to the bed body.

FIGS. 3 to 8 show the overall structure of the bed apparatus 1. FIGS. 3 to 5 show a first typical available mode of the bed apparatus 1 and FIGS. 6 and 7 show a second typical mode thereof, while FIG. 8 shows a third typical mode of the bed apparatus 1. FIG. 3 is a front elevational view, FIGS. 4 and 6 are plan views, and FIGS. 5, 7 and 8 are left side elevational views respectively.

Figure 21:
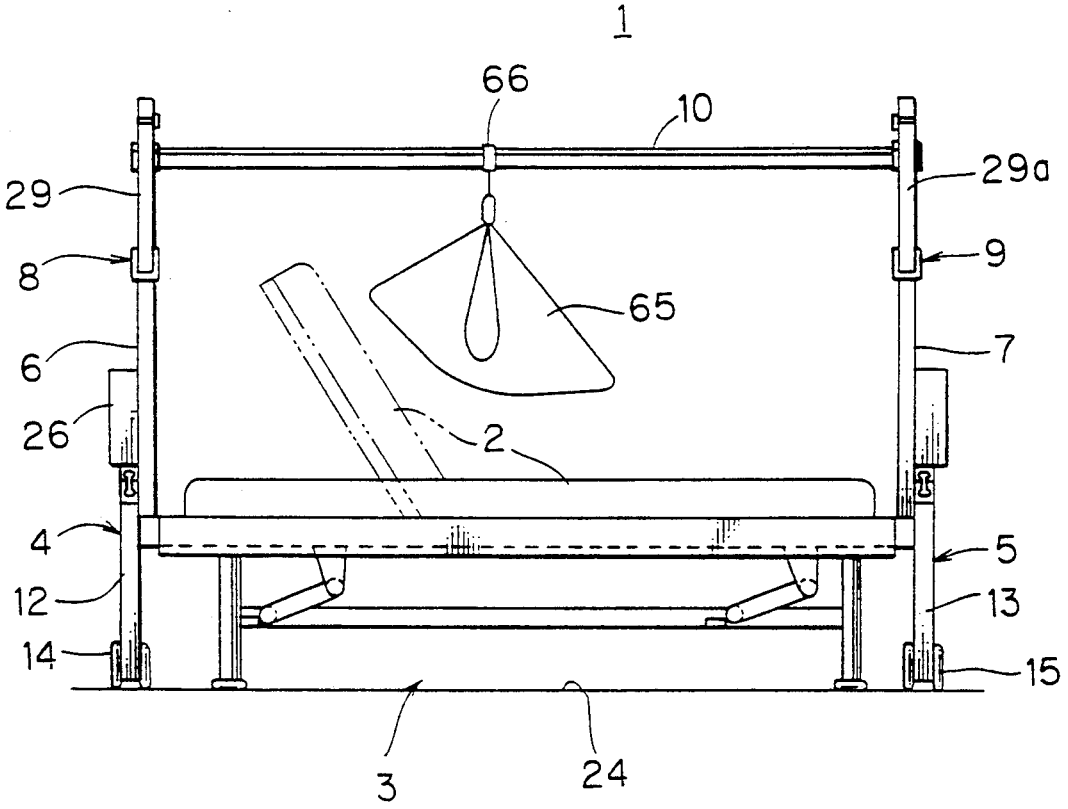
FIG. 21 is a front elevational view corresponding to FIG. 3, showing a hammock which is used in place of the hanger member.

The principal components of the bed apparatus 1 of this embodiment comprise a bed body 3 and a mattress 2 which is spread thereon. The bed body 3 is so hinged that it is possible to arbitrarily change a partially inclined state of the mattress 2. As described below, FIG. 21 shows a partially raised state of the mattress 2 with phantom lines.

A pair of sliders 4 and 5 are mounted on both end portions along the longitudinal direction of the bed body 3, to be slidable along the cross direction of the bed body 3. Upon such sliding movement, the sliders 4 and 5 extend in the cross direction of the bed body 3, as most clearly shown in FIGS. 6 and 7.

A pair of upright bars 6 and 7 is mounted to upwardly extend from the sliders 4 and 5 respectively.

A pair of support members 8 and 9 is mounted to be movable along the upright bars 6 and 7 respectively and stoppable at moved positions.

Two parallel side bars 10 and 11 are provided to couple the pair of support members 8 and 9 with each other.

The bed apparatus 1 will now be described in more detail.

Figure 9:
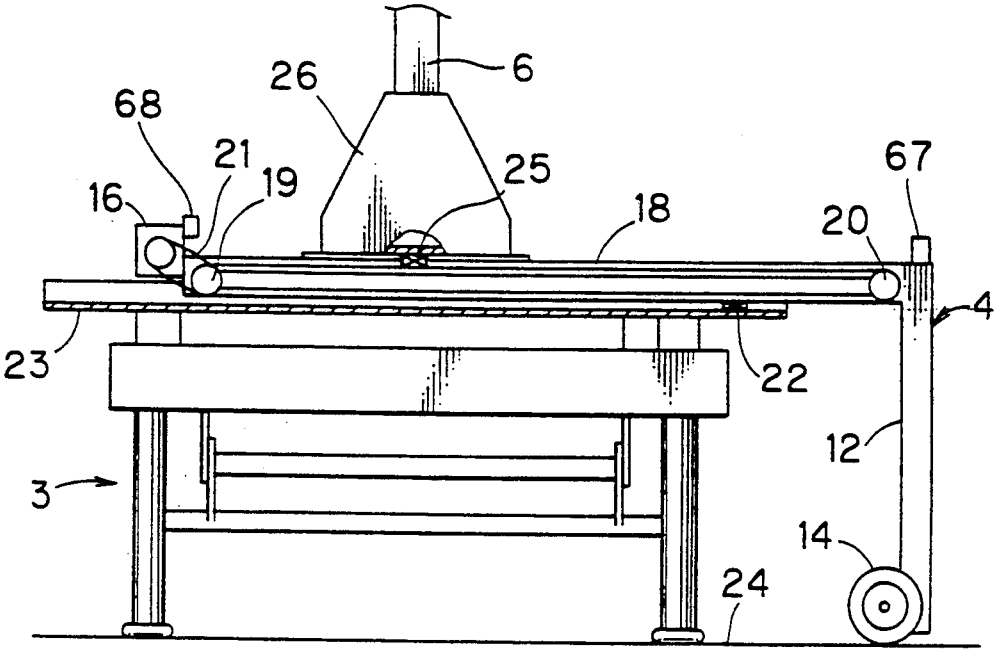
FIG. 9 is a left side elevational view corresponding to FIG. 5, showing a mechanism for causing the slider to slide along the bed body.
Figure 10:
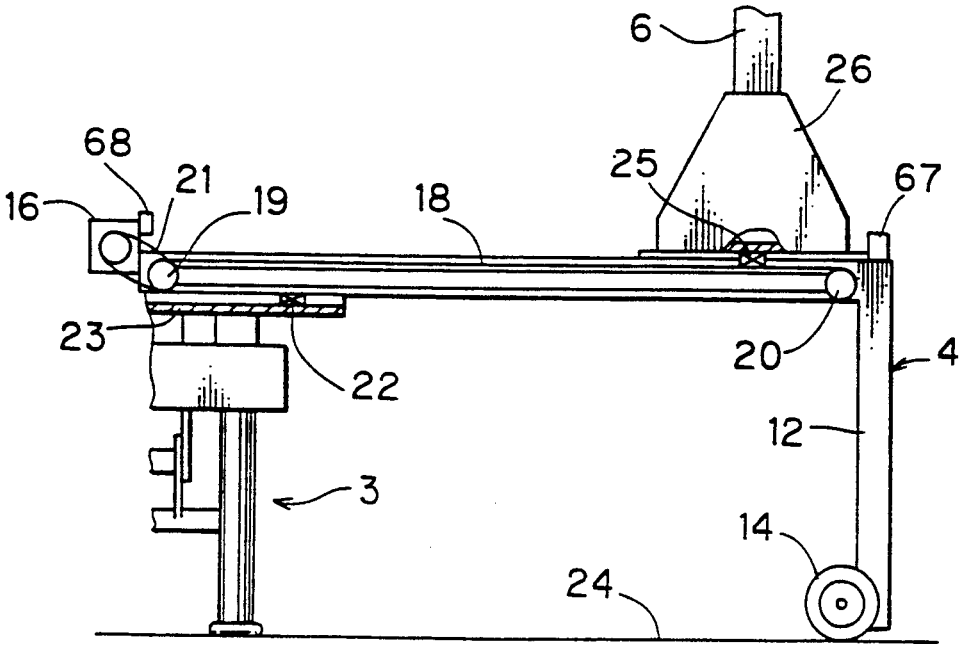
FIG. 10 is a left side elevational view corresponding to FIG. 7, showing the mechanism shown in FIG. 9.
Figure 11:
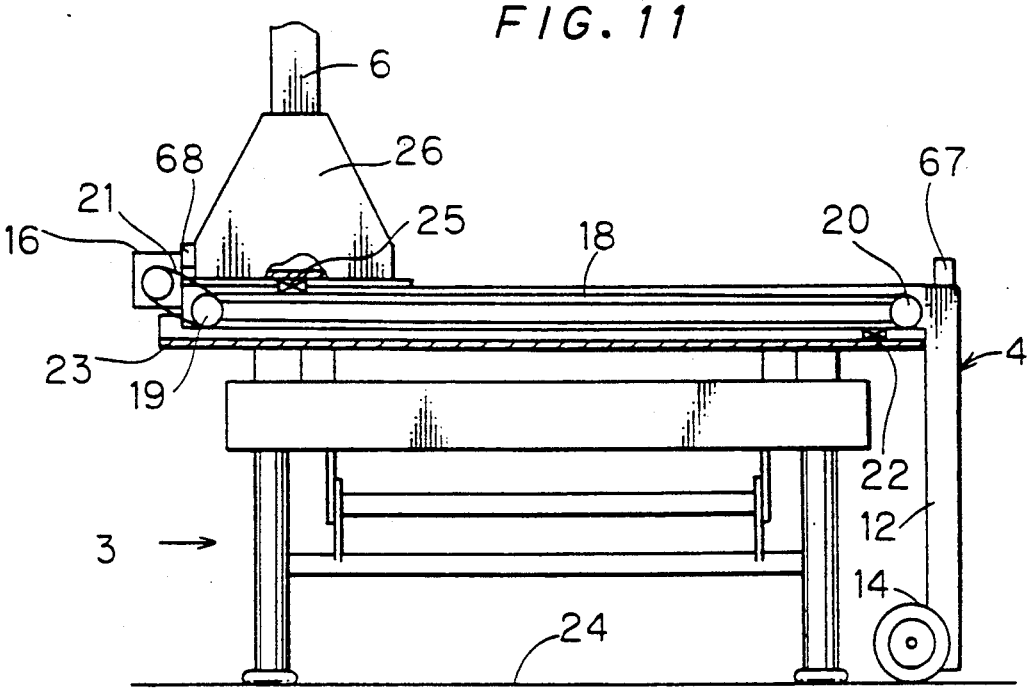
FIG. 11, is a left side elevational view corresponding to FIG. 8, showing the mechanism shown in FIG. 9.

First, a structure for making the slider 4 or 5 slide along the cross direction of the bed body 3 is described. FIGS. 9, 10, and 11, which correspond to FIGS. 5, 7 and 8 respectively, show the first slider 4. The second slider 5 is provided with a structure which is substantially identical to that for the first slider 4. It is noted here that FIGS. 9 to 11 are partially fragmented or simplified, in order to facilitate the understanding of the operation of the slider 4.

The sliders 4 and 5 have L-shaped configurations with vertically extending leg portions 12 and 13 respectively. Wheels 14 and 15 are mounted on lower ends of the leg portions 12 and 13 respectively.

The sliders 4 and 5 are respectively driven to slide by traverse motors 16 and 17, which are fixed to the sliders 4 and 5 respectively.

Mainly with reference to FIGS. 9 to 11, the structure for driving the first slider 4 is now described. According to this embodiment, the upright bar 6 is also moved on the slider 4 upon sliding movement of the slider 4.

A chain 18 is arranged on a horizontally extending portion of the slider 4. This chain 18 may be replaced by a belt or the like. The chain 18 is extended along sprocket wheels 19 and 20, which are held by the slider 4. Rotation of the motor 16 is transmitted to the first sprocket wheel 19 through a belt 21, for example.

A fixture 22 is fixed to a prescribed position on a lower path for the chain 18. This fixture 22 is also fixed to a prescribed position of a guide 23 which is provided on the bed body 3.

When the rotation of the motor 16 is transmitted to the sprocket wheel 19 through the belt 21, the chain 18 circulates to cause the slider 4 to slide along the guide 23 since the lower path of the chain 18 is fixed by the guide 23 through the fixture 22. The sliding direction of the slider 4 can be varied with the direction of rotation of the motor 16. In such sliding movement of the slider 4, the wheel 14 rolls on a floor face 24.

Another fixture 25 is fixed to a prescribed position on an upper path for the chain 18. This fixture 25 is also fixed to a base portion 26 of the upright bar 6.

When the chain 18 circulates in the aforementioned manner, the base portion 26, i.e., the upright bar 6, is displaced with respect to the slider 4, since the upper path for the chain 18 is fixed with the base portion 26 through the fixture 25.

When the slider 4 slides along the bed body 3, the upright bar 6 is displaced in the same direction on the slider 4. In this case, the amount of displacement of the slider 4 with respect to the bed body 3 is equal to that of the upright bar 6 with respect to the slider 4.

In the state shown in FIG. 9, the upright bar 6 is located at the cross-directional center of the bed body 3. In this state, the slider 4 slightly extends sidewardly from the bed body 3.

When the slider 4 extends as much as possible to the side of the bed body 3 as shown in FIG. 10, the upright bar 6 is brought into a position close to the leg portion 12 on the slider 4. The upright bar 6 moves relative to the bed body 3 by an amount of displacement twice that of the slider 4 with respect to the bed body 3. Thus, it is possible to sufficiently sidewardly separate the upright bar 6 from the bed body 3 while reducing the amount of extension of the slider 4 from the bed body 3.

When the slider 4 comes still closer to the bed body 3 as shown in FIG. 11 from the state of FIG. 9, on the other hand, the upright bar 6 is brought into a position close to the motor 16 on the slider 4, whereby the upright bar 6 is moved toward a side portion along the cross direction of the bed body 3. The state shown in FIG. 11 is generally implemented when the aforementioned side bars 10 and 11 are not used. Therefore, such movement of the upright bar 6 is further effective for protecting the sick person or the like, who is laid on the bed body 3, against oppression caused by the side bars 10 and 11, the support members 8 and 9 and the upright bars 6 and 7.

The motor 16 is so stopped and controlled that it defines the terminating ends of the aforementioned sliding movement of the slider 4 and the upright bar 6. For this purpose, for example, microswitches 67 and 68 are provided at both ends of the moving path for the upright bar 6 on the slider 4. As shown in FIG. 10 or 11, therefore, the motor 16 is controlled to stop when the base portion 26 of the upright bar 6 comes into contact with the microswitch 67 or 68. Thus, it is possible to regularly bring the upright bar 6 into a constant position when the slider 4 extends from the bed body 3 to the side thereof as much as possible.

Figure 12:
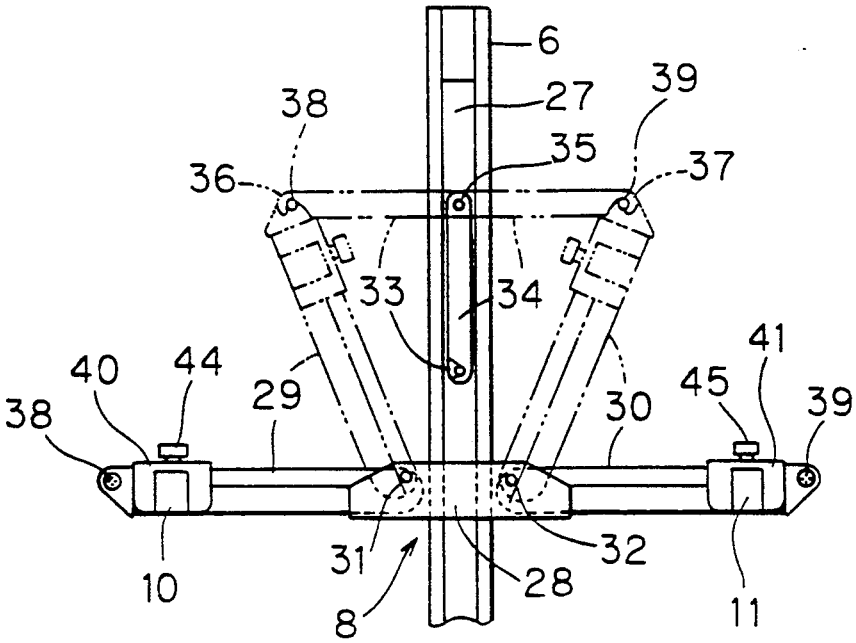
FIG. 12 is a right side elevational view showing the structure of a support member.
Figure 13:
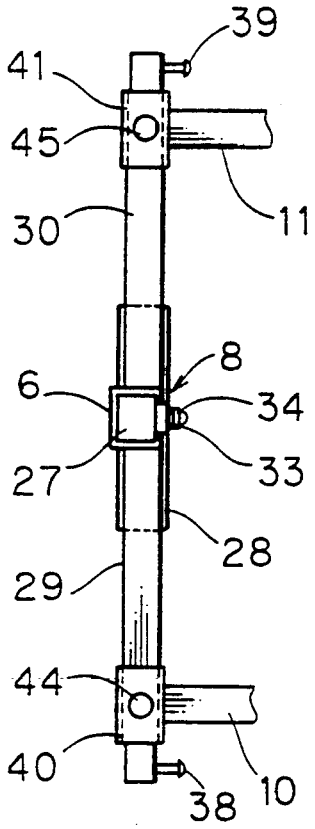
FIG. 13 is a plan view showing the structure of the support member.
Figure 14:
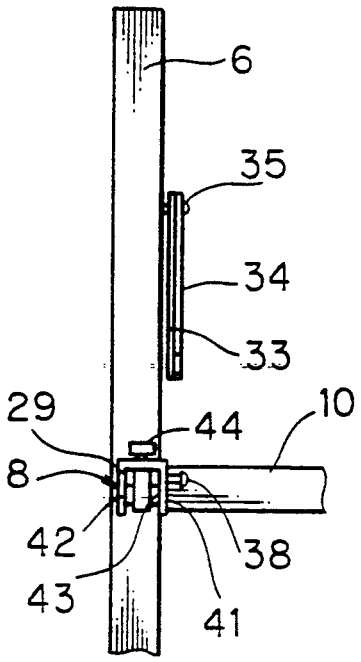
FIG. 14 is a front elevational view showing the structure of the support member.

The structure of the support member 8 or 9 is now described in detail. The support members 8 and 9 are symmetrical in structure to each other. FIG. 12 is a right side elevational view showing the first support member 8, FIG. 13 is a plan view thereof, and FIG. 14 is a front elevational view of the support member 8, respectively.

Figure 15:
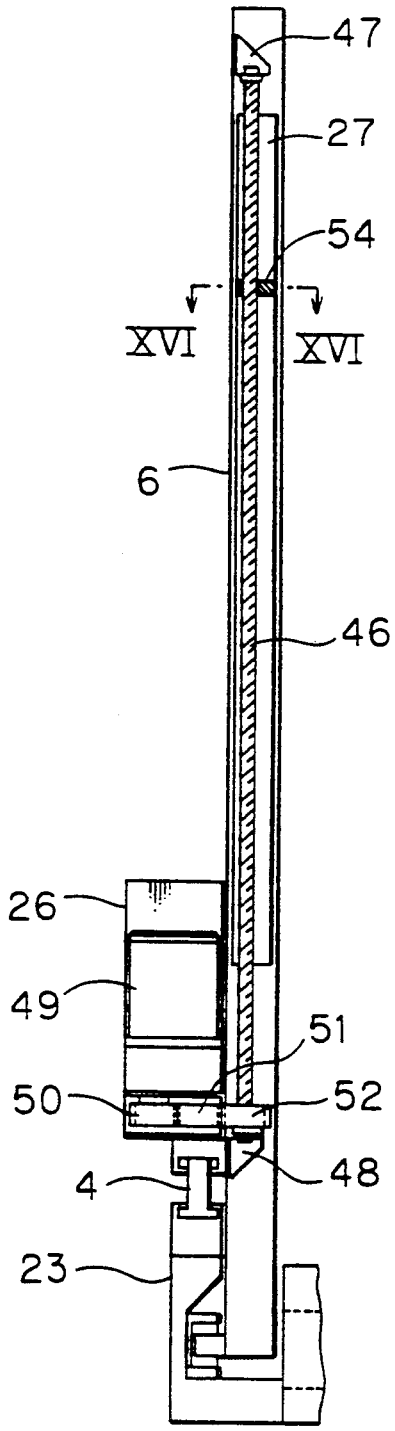
FIG. 15 is a longitudinal sectional view showing the relationship between a sliding block, which is included in the support member, and an upright member related thereto.
Figure 16:
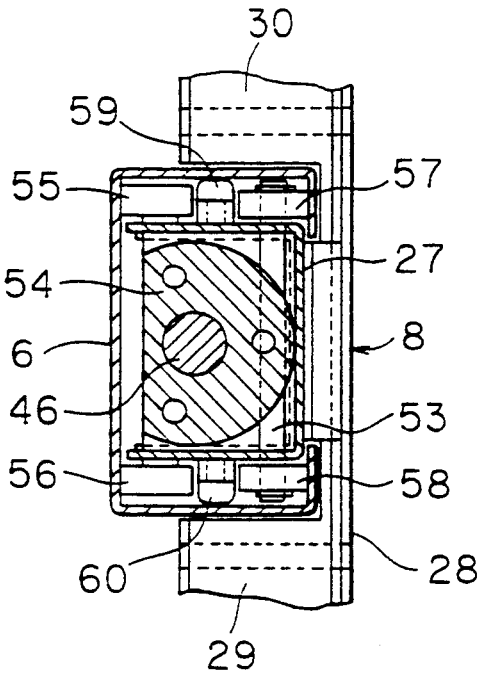
FIG. 16 is an enlarged sectional view taken along the line XVI—XVI in FIG. 15.

The support member 8 comprises a sliding block 27 which is moved along the respective upright bar 6. The relation between the sliding block 27 and the upright bar 6 will be described below with reference to FIGS. 15 and 16. A bracket 28 having a U-shaped section, for example, is fixed to the sliding block 27. This bracket 28 is also shown in FIG. 16 described below. A pair of arms 29 and 30 are mounted on the brackets 28. These arms 30 and 29 extend in opposite directions from the bracket 28 along the cross direction of the bed body 3.

As shown by phantom lines in FIG. 12, the arms 29 and 30 are upwardly rotatable about pins 31 and 32 relative to the bracket 28. Further, the sliding block 27 rotatably holds two hook links 33 and 34 by a common pin 35. Hook portions 36 and 37 are provided on respective free ends of the hook links 33 and 34. On the other hand, engaging pins 38 and 39, which are engageable with the hook portions 36 and 37 respectively, are provided on respective free ends of the arms 29 and 30. When the arms 29 and 30 are upwardly rotated as shown by phantom lines in FIG. 12, the hook portions 36 and 37 of the hook links 33 and 34 engage with the engaging pins 38 and 39 respectively, to fix the upwardly rotated states of the arms 29 and 30.

The aforementioned two side bars 10 and 11 are mounted on the arms 29 and 30 respectively. Thus, the side bars 10 and 11 can be located at upper and lower positions, following the aforementioned rotation of the arms 29 and 30. FIG. 12 shows the lower and upper positions of the side bars 10 and 11 with solid and phantom lines. FIG. 8 shows a state corresponding to the state shown with the phantom lines in FIG. 12. The side bars 10 and 11 are thus brought into the upper positions to protect the sick person or the like, who is laid on the bed body 3, against injury, as well as to facilitate medical examination of the sick person or the like with no hindrance. Further, it is also possible to implement another application mode as described below with reference to FIG. 21, by bringing the side bars 10 and 11 to the upper positions as shown with the phantom lines in FIG. 12.

While FIGS. 12 to 14 show a structure which is related to the first support member 8, FIGS. 3 to 8 and FIG. 21 show the second support member 9. Elements of the second support member 9 which are in laterally symmetrical positions relative to those included in the first support member 8, are denoted by the same reference numerals as shown in FIGS. 12 to 14 with subscripts "a", to omit a redundant description.

According to this embodiment, the positions of the side bars 10 and 11 are changeable on the arms 29, 29*a*, 30 and 30*a*. The relationship between the arms 29 and 30 and the side bars 10 and 11 shown in FIGS. 12 to 14, is established by clamps 40 and 41 having inverted U-shaped sections mounted on respective end portions of the side bars 10 and 11. The arms 29 and 30 have T-shaped sections. Further, guide blocks 42 and 43 for holding lower portions of the arms 29 and 30 having the T-shaped sections are mounted on the clamps 40 and 41, as shown in FIG. 14 with reference to the clamp 40. Thus, the clamps 40 and 41, which are longitudinally movable along the arms 29 and 30, are held against sideward displacement from the arms 29 and 30. The clamps 40 and 41 are provided with clamp screws 44 and 45 respectively. These clamp screws 44 and 45 are so tightened as to fix the positions of the clamps 40 and 41 on the arms 29 and 30.

The aforementioned structure is also employed at the other ends of the side bars 10 and 11 respectively.

Thus, the distance between the pair of side bars 10 and 11 can be varied with the positions of the side bars 10 and 11 with respect to the arms 29 and 30. For example, the distance between the side bars 10 and 11 shown in FIG. 4 is wider than that shown in FIG. 6. The distance between the side bars 10 and 11 is thus changed in response to the physical constitution of the sick person or the like, for example, as described below.

A structure for making the support member 8 or 9 movable along the upright bar 6 or 7 and stoppable at a moved position is now described. FIG. 15 is a longitudinal sectional view showing relation between the sliding block 27 which is included in the first support member 8 and the related upright bar 6. FIG. 16 is an enlarged sectional view taken along the line XVI—XVI in FIG. 15. The relationship between the sliding block 27*a* which is included in the second support member 9 and the upright bar 7 related thereto, is established by a structure (not shown) which is symmetrical to that shown in FIGS. 15 and 16. Therefore, only the relationship between the sliding block 27 which is included in the first support member 8 and the related upright bar 6, is described in detail.

Referring to FIGS. 15 and 16, the upright bar 6 has a C-shaped section, in order to receive the sliding block 27 as well as to enable mounting of the bracket 28 (FIG. 16) on the sliding block 27. A lead screw 46 is arranged in the upright bar 6, to be rotatable about its central axis. FIG. 15 shows brackets 47 and 48 for rotatably holding both ends of the lead screw 46.

The aforementioned base portion 26 of the upright bar 6 has a hollow structure, to contain a motor 49 for vertical movement therein. This motor 49 is reciprocally rotatable in one or the opposite direction. Rotation of the motor 49 is transmitted to the lead screw 46, successively through gear 50, 51 and 52.

A female screw block 54 is fixed to the sliding block 27 through a mounting plate 53. This female screw block 54 is provided with a female threading, which is fitted to the lead screw 46. When the lead screw 46 is rotated upon rotation of the motor 49, therefore, the sliding block 27 is vertically moved. When the motor 49 is stopped, on the other hand, the lead screw 46 is also stopped so that it is impossible to transmit any motion from the female screw block 54 to the lead screw 46, whereby the sliding block 27 is stopped in its moved position by such stoppage of the lead screw 46.

FIG. 16 shows some elements for smoothly guiding the movement of the sliding block 27 along the upright bar 6. A plurality of rotatable guide rollers 55, 56, 57 and 58 and guide shoes 59 and 60 are provided on the sliding block 27. The guide rollers 55 to 58 and the guide shoes 59 and 60 come into contact with the inner surface of the upright bar 6 from various directions, thereby facilitating a smooth vertical movement of the sliding block 27 within the upright bar 6.

Although FIG. 16 shows four guide rollers 55 to 58 and two guide shoes 59 and 60, appropriate numbers of such guide rollers and guide shoes (not shown) may be vertically distributed along the sliding block 27.

The support member 8, more specifically the bracket 28 (not shown in FIG. 15), is mounted on the lower end of the sliding block 27. The lower end of the sliding block 27 is movable to downwardly project from the upright bar 6 beyond the gear 52 and the lower end of the upright bar 6. Thus enabled is the position of the support member 8, which is shown with phantom lines in FIG. 7.

FIGS. 3 to 7 illustrate appropriate numbers of hanger members 61, which are provided on the side bars 10 and 11 respectively. These hanger members 61 are adapted to raise the sick person or the like from a lying condition. FIGS. 17 to 20 show the structure of each such hanger member 61 in detail.

Figure 17:
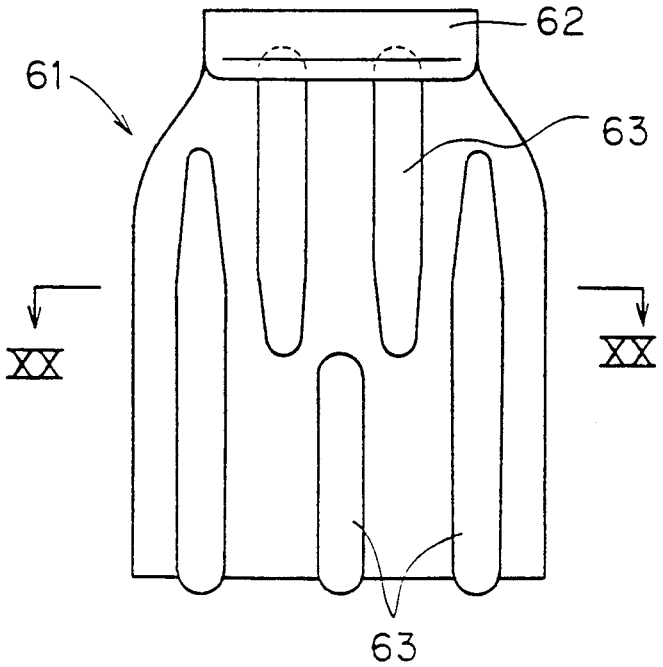
FIG. 17 is a front elevational view showing a hanger member.
Figure 18:
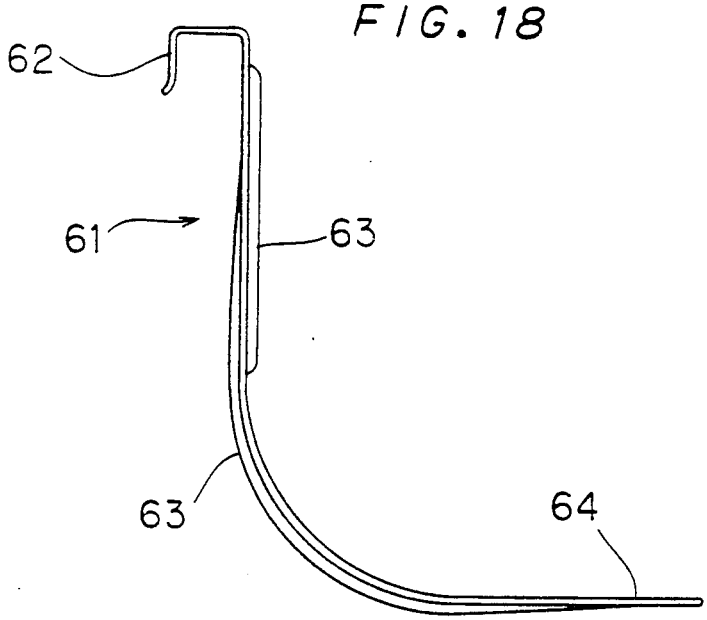
FIG. 18, is a right side elevational view showing the hanger member.
Figure 19:
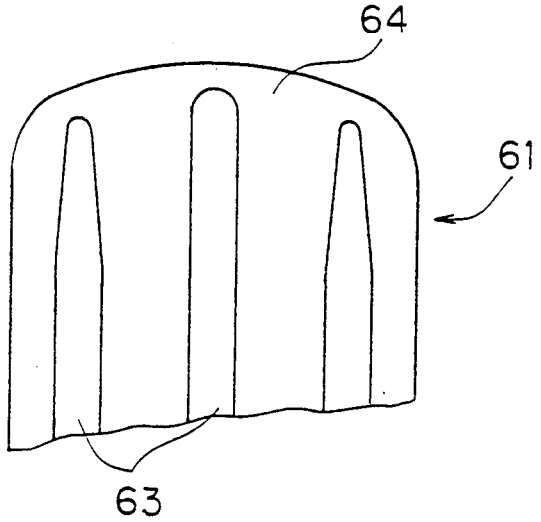
FIG. 19 is a plan view partially showing the hanger member.
Figure 20:
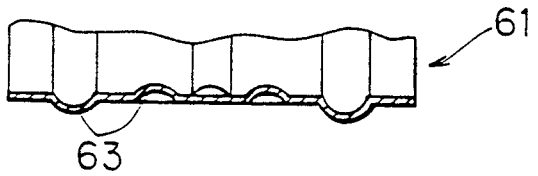
FIG. 20 is a sectional view taken along the line XX—XX in FIG. 17.

FIG. 17 is a front elevational view showing the hanger member 61 and FIG. 18 is a right side elevational view thereof, while FIG. 19 is a plan view partially showing the hanger member 61, and FIG. 20 is a sectional view taken along the line XX—XX in FIG. 17.

The hanger member 61 is made of a relatively rigid material such as hard plastic, aluminum or stainless steel, for example. The hanger member 61 is curved to provide an L-shaped configuration as a whole, and provided with a hook portion 62, which is engageable with the side bar 10 or 11, on its one end. A plurality of ribs 63 are distributed on the hanger member 61, in order to ensure at least a prescribed level of strength while reducing the thickness as well as the weight of the hanger member 61 to the utmost. As clearly shown in FIG. 20, such ribs 63 are preferably formed to provide rounded sections.

A plurality of these hanger members 61 are provided. In order to use the hanger members 61, horizontally extending bottom portions 64 of the hanger members 61 are inserted under the body of the sick person or the like, who is lying on the bed body 3. In this case, the plurality of hanger members 61 is appropriately distributed on both sides of the body of the sick person or the like in consideration of the weight of the sick person or the like. On the other hand, the height of and the distance between the pair of side bars 10 and 11 are adjusted in accordance with the aforementioned mechanism in consideration of the positions of the hook portions 62 of the hanger members 61. Then, the hook portions 62 of the hanger members 61 are made to engage with the side bars 10 and 11.

The aforementioned hanger members 61 can be advantageously inserted under the body of the sick person or the like, without raising him. After the hook portions 62 of the hanger members 61 engage with the side bars 10 and 11, the side bars 10 and 11 are so displaced that it is possible to move the sick person or the like to a desired position.

FIG. 21 shows a hammock 65, which is used for raising the sick person or the like in place of the aforementioned hanger members 61.

The hammock 65 is made of thick cloth or the like as a whole, in a configuration for covering the sick person or the like in a sitting condition. The hammock 65 is suspended from the side bars 10 and 11 through a suspender 66.

In the state shown in FIG. 21, the arms 29, 30, **29*a* and 30*a* are fixed in upwardly rotated states, so that the side bars 10 and 11 are sufficiently increased in height. Thus, it is possible to use the hammock 65**, which covers the sick person or the like in a sitting condition.

The hammock 65 is preferably used when the illness of the sick person or the like is relatively slight. In order to cover the sick person or the like with the hammock 65, further, it is preferable to previously bring the sick person or the like into a sitting condition. If the bed body 3 is hinged, the mattress 2 is partially raised up as shown in phantom lines in FIG. 21 to bring the sick person or the like into a sitting condition, thereby reducing the burden of a nurse. The bathtub 103 and the relationship between this bathtub 103 and the bed body 3 will now be described. As shown in FIG. 1, the bathtub 103 is coupled to the bed body 3 by guide members 104. As shown in FIG. 2, this bathtub 103 can be stored in a sidewardly open space 105, which is defined under the bed body 3.

The bed body 3 comprises a bottom plate 106 forming a bed face, and leg members 107 which are adapted to bring the bottom plate 106 to a prescribed vertical position from a floor face 24 as shown in FIG. 3, for example.

Figure 22:
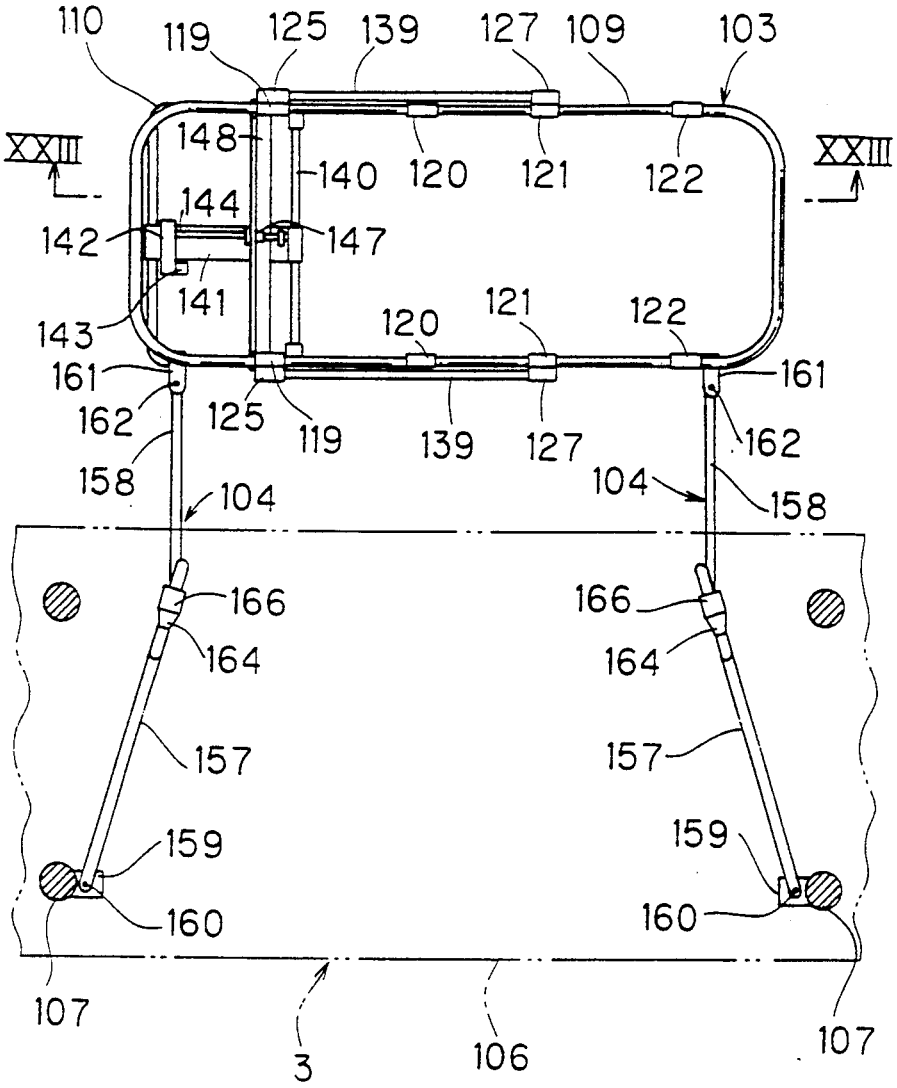
FIG. 22 is a plan view showing the framework of the bathtub, in a state ready for use as shown in FIG. 1.
Figure 23:
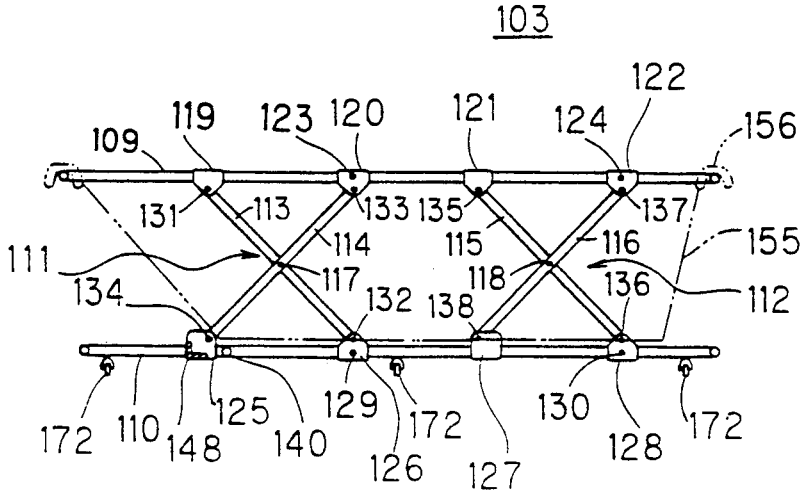
FIG. 23 is a sectional view taken along the line XXIII—XXIII in FIG. 22.
Figure 24:
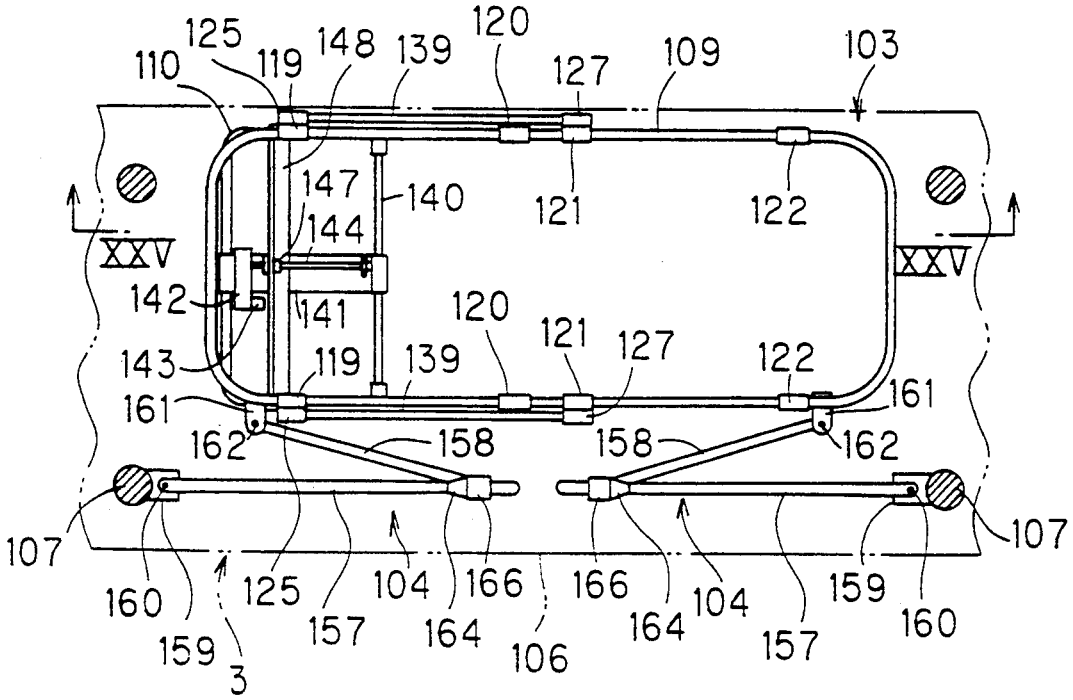
FIG. 24 is a plan view showing the framework of the bathtub, in a stored state as shown in FIG. 2.
Figure 25:
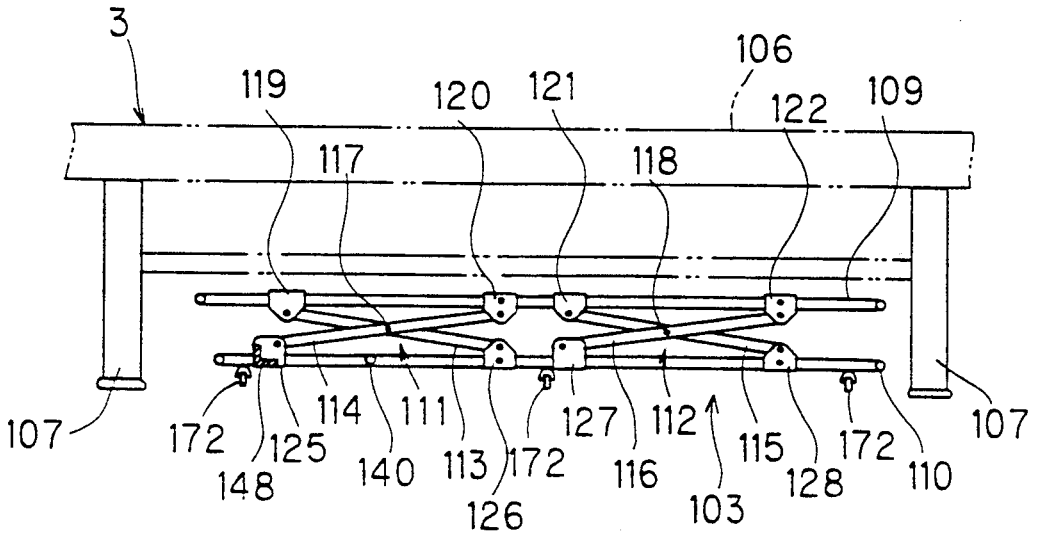
FIG. 25 is a sectional view taken along the line XXV—XXV in FIG. 24.

Comparing FIGS. 23 and 25 with each other, it is understood that the bathtub 103 is retractable or rather collapsible in its vertical direction. In addition to these figures, FIGS. 22 and 24 illustrate only the framework of the bathtub 103.

As shown in FIGS. 22 to 25, the framework of the bathtub 103 comprises an upper frame 109 and a lower frame 110, which is arranged under the upper frame 109 in parallel thereto. The upper and lower frames 109 and 110 are coupled by link means for collapsing and extending the tub 103. For this purpose, link means of symmetrical construction relative to each other about the longitudinal center line of the bathtub 103, are provided. Therefore, only one of such link means is described with reference to FIGS. 23 and 25 while the other one is denoted by similar reference numerals, to omit a redundant description.

As shown in FIGS. 23 and 25, the link means includes a front crossing link 111 and a rear crossing link 112. The front crossing link 111 comprises a pair of diagonally crossing support bars 113 and 114, while the rear crossing link 112 also comprises a pair of diagonally crossing support bars 115 and 116. The support bars 113 and 114 are rotatably coupled or journalled to each other by a coupling pin 117, while the support bars 115 and 116 are also rotatably coupled with each other by a coupling pin 118.

A sliding bracket 119, a fixed bracket 120, another sliding bracket 121, and another fixed bracket 122 are arranged on the upper frame 109 in this order from the front side. The sliding brackets 119 and 212 are slidable along the upper frame 109, while the fixed brackets 120 and 122 are fixed to the upper frame 109 by fixing pins 123 and 124 respectively.

A sliding bracket 125, a fixed bracket 126, another sliding bracket 127 and another fixed bracket 128 are arranged on the lower frame 110 in this order from the front side. The sliding brackets 125 and 127 are slidable along the lower frame 110, while the fixed brackets 126 and 128 are fixed to the lower frame 110 by fixing pins 129 and 130 respectively.

Upper and lower end portions of the support bar 113 are rotatably coupled to the sliding bracket 119 and the fixed bracket 126 respectively, by coupling pins 131 and 132 in the front crossing link 111. Further, upper and lower end portions of the support bar 114 are rotatably coupled to the fixed bracket 120 and the sliding bracket 125 respectively by coupling pins 133 and 134.

Upper and lower end portions of the support bar 115 are rotatably coupled to the sliding bracket 121 and the fixed bracket 128 respectively by coupling pins 135 and 136 in the rear crossing link 112. Further, upper and lower end portions of the support bar 116 are rotatably coupled to the fixed bracket 122 and the sliding bracket 127 respectively, by coupling pins 137 and 138.

When the sliding brackets 119 and 121 slide forwardly along the upper frame 109 and the sliding brackets 125 and 127 slide forwardly along the lower frame 110 from the state shown in FIG. 23 respectively, the upper frame 109 is downwardly moved to approach to the lower frame 110, as shown in FIG. 25.

In order to interlock the aforementioned operations of the front and rear crossing links 111 and 112, an interlocking bar 139 couples the sliding brackets 125 and 127 to each other as shown in FIGS. 22 and 24.

In order to perform the aforementioned operations of the front and rear crossing links 111 and 112 the following structure is employed:

As shown in FIGS. 22 to 25, a fixed crossbar 140 is fixed to the lower frame 110, so that a fixed table 141 is extended across the fixed crossbar 140 and across a front side of the lower frame 110. Various elements are mounted in relation to the fixed table 141, as shown in FIGS. 26 and 27 in an enlarged manner.

Figure 26:
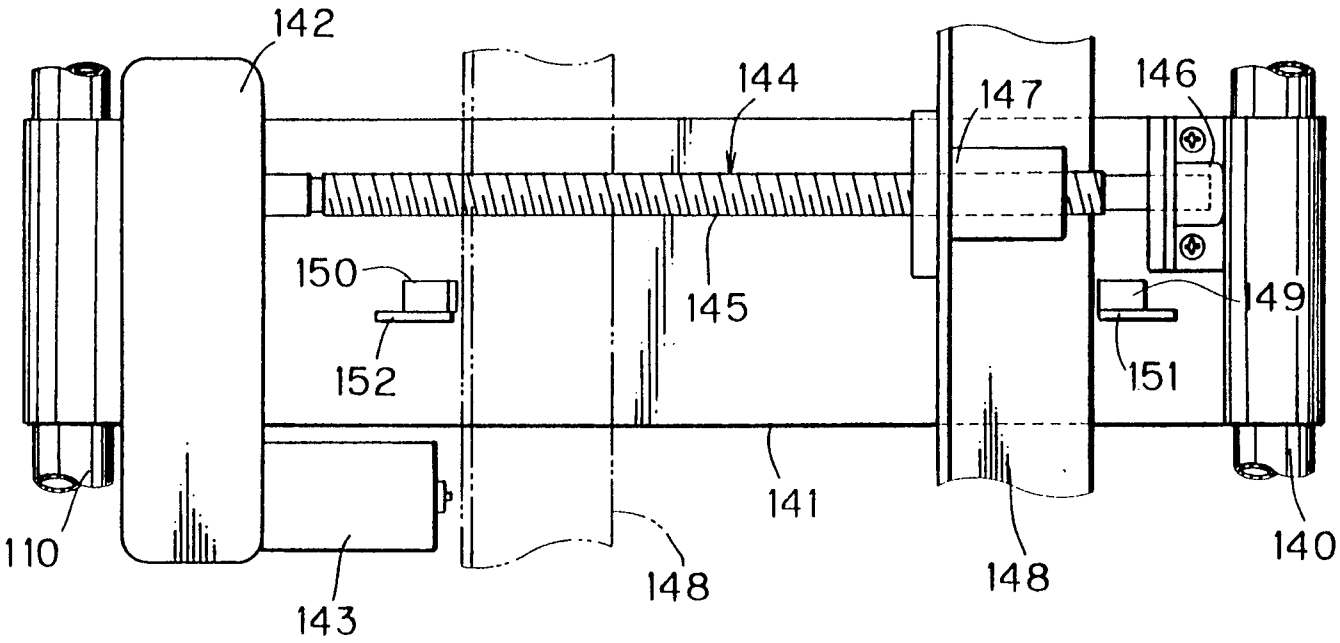
FIG. 26 is a plan view showing a structure on a fixed table shown in FIGS. 22 and 24 in an enlarged manner.
Figure 27:
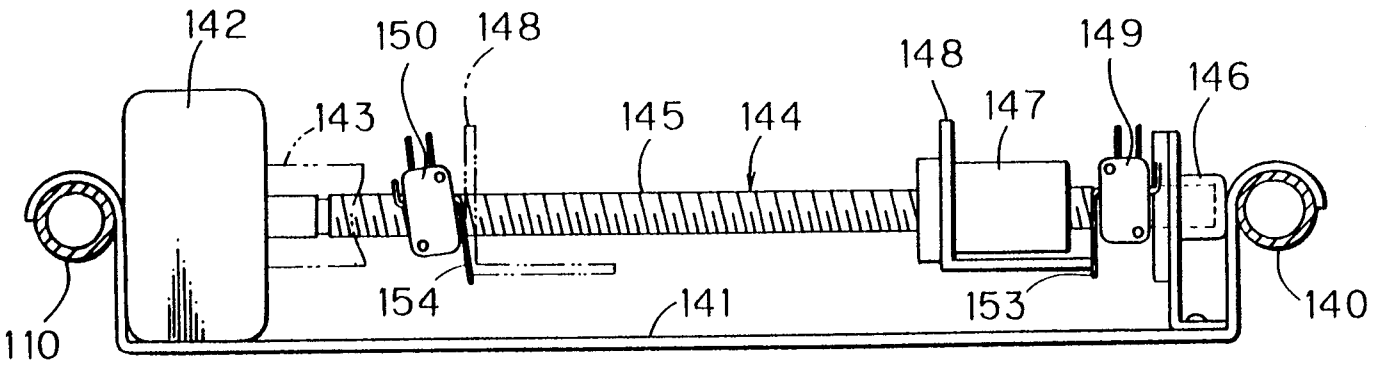
FIG. 27 is a front elevational view of the structure shown in FIG. 26.

Referring to FIGS. 26 and 27, a motor 143 is mounted on the fixed table 141 in combination with a speed reducer 142. Rotation of the motor 143 is transmitted to a lead screw 144 through the speed reducer 142. A male threading 145 is formed on the outer peripheral surface of the lead screw 144. An end of the lead screw 144 is rotatably held by a bracket bearing 146 which is mounted on the fixed table 141.

The lead screw 144 is provided thereon with a female screw block 147, which has a female threading that fits to the male threading 145 of the lead screw 144 on its inner peripheral surface. A movable crossbar 148 is fixed to the female screw block 147. Both end portions of the movable crossbar 148 are fixed to the aforementioned sliding bracket 125, which slides along the lower frame 110.

When rotation of the motor 143 is transmitted to the lead screw 144 through the speed reducer 142 to rotate the lead screw 144, the female screw block 147 is moved longitudinally along the lead screw 144 with the movable crossbar 148. The rotation of the motor 143 is controlled to stop by microswitches 149 and 150, to define respective terminating ends of the movement of the female screw block 147. These microswitches 149 and 150 are mounted on the fixed table 141 by mounting brackets 151 and 152, so that actuators 153 and 154 of the microswitches 149 and 150 are brought into contact with the movable crossbar 148 respectively. Thus, the movable crossbar 148 is moved between positions shown by solid and phantom lines in FIGS. 26 and 27.

Figure 28:
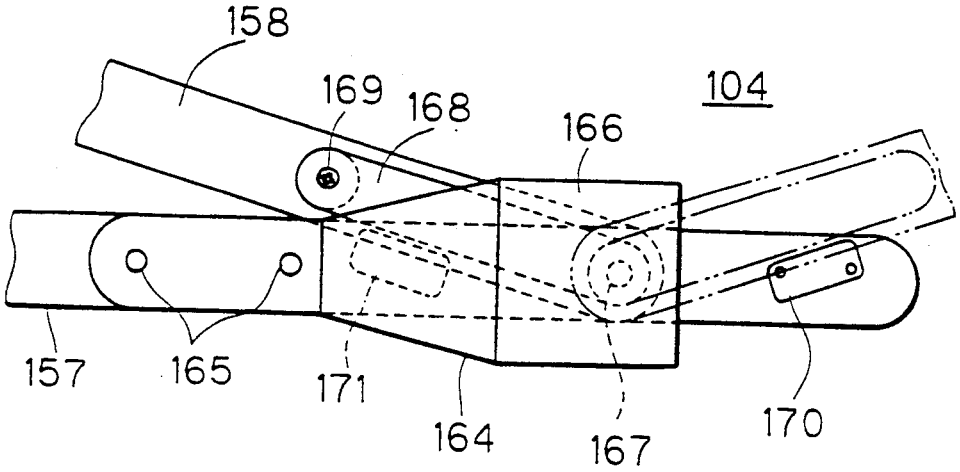
FIG. 28 is a plan view showing a principal part of each guide member shown in FIGS. 22 and 24 in an enlarged manner.

The position of the movable crossbar 148 shown in FIGS. 22 and 23 corresponds to that shown by solid lines in FIGS. 26 and 27, while the position shown in FIGS. 24 and 25 corresponds to that shown by phantom lines in FIGS. 26 and 28.

Referring to FIGS. 22 and 23, the movable crossbar 148 is shown positioned at the rightmost end of its movable range. Thus, the sliding brackets 125 and 119 are simultaneously approached to the fixed brackets 126 and 120 respectively, to vertically lengthen the front crossing link 111. Further, the operation of the sliding bracket 125 is transmitted to the sliding bracket 127 of the rear crossing link 112 through the interlocking bar 139. Thus, the sliding brackets 127 and 121 simultaneously close in with the fixed brackets 128 and 122 respectively, to vertically lengthen the rear crossing link 112. Therefore, the upper frame 109 is separated from the lower frame 110, to vertically extend the bathtub 103 for using the bathtub 103.

Referring to FIGS. 24 and 25, on the other hand, the movable cross bar 148 is positioned at the leftmost end of its movable range. Thus, the sliding brackets 125 and 119 of the front crossing link 111 are simultaneously separated from the fixed brackets 126 and 120 respectively, to transversely lengthen the front crossing link 111. Further, the operation of the sliding bracket 125 is transmitted to the sliding bracket 127 through the interlocking bar 139, so that the sliding brackets 127 and 121 are simultaneously separated from the fixed brackets 128 and 122 respectively, to transversely lengthen the rear crossing link 112. Thus, the upper frame 109 closes in with the lower frame 110, to vertically contract the bathtub 103 for storage when the bathtub 103 is not used.

Such vertical expansion and contraction of the bathtub 103 is achieved by driving the motor 143, the rotational direction of which is selected to reverse the movement.

In order to allow such operation of the framework of the bathtub 103, a bathtub body 155 shown in FIG. 1, for example, for holding hot water is made of a waterproof sheet material such as canvas. FIG. 23 shows the bathtub body 155 in phantom lines. The upper edge or portion of the bathtub body 155 is secured to a cover frame 156 of resin molding, for example. As shown by phantom lines in FIG. 23, the cover frame 156, which has an inverted U-shaped section, is located to cover the upper frame 109.

The bathtub body 155 is preferably provided with an openable water outlet (not shown) in a proper position. The cover frame 156 may be provided with a faucet for supplying hot water, or a mounting part for mounting such a faucet.

One of the aforementioned guide members 104 is partially shown in FIG. 1. The guide members 104 are adapted to guide the bathtub 103 to be movable between a position under the bottom plate 106 of the bed body 3 and a position to the side of the bottom plate 106.

FIGS. 22 and 24 illustrate the entire structures of the guide members 104. The guide members 104, which are provided on front and rear portions of the bathtub 103 respectively, are symmetrical in structure to each other. Therefore, only the guide member 104 provided on the front portion of the bathtub 103 is described in detail while the rear guide member 104 is shown with similar reference numerals to omit redundant description.

Figure 29:
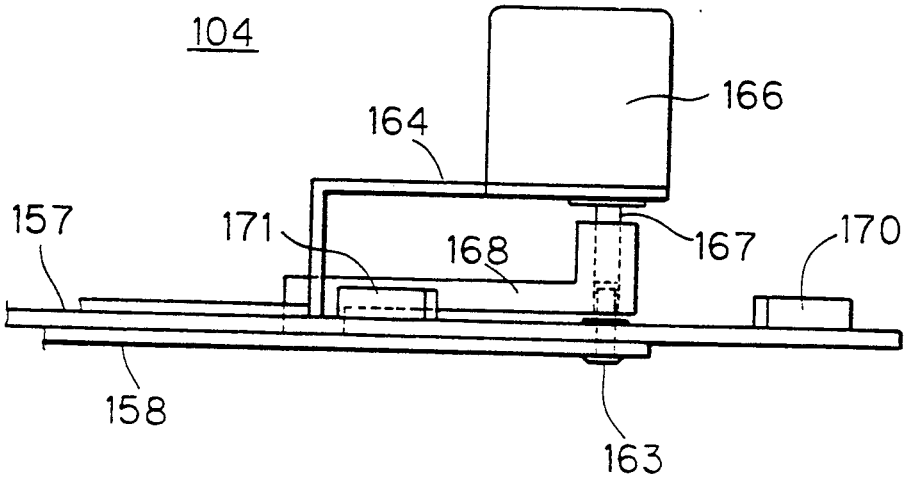
FIG. 29 is a top plan view of the part shown in FIG. 28.

The front guide member 104 comprises first and second arms 157 and 158. The first arm 157 is rotatably coupled to a bracket 159, which is mounted on one of the leg members 107 of the bed body 3, by a coupling pin 160. The second arm 158 is rotatably coupled to a bracket 161, which is mounted on the lower frame 110 of the bathtub 103, by a coupling pin 162. Further, the first and second arms 157 and 158 are rotatably coupled with each other. FIGS. 28 and 29 show such a coupled portion in an enlarged manner.

Referring to FIGS. 28 and 29, the first arm 157, which is formed by a plate, is positioned above the second arm 158, which is also formed by a plate. In such an overlapping state, the first and second arms 157 and 158 are rotatably coupled to each other by a coupling pin 163 passing through both plate arms.

A bracket 164 is fixed onto the first arm 157 by a fixing pin 165, and a motor 166 is mounted on this bracket 164. A lever 168 is fixed to a motor shaft 167 of the motor 166, to be integrally rotated with the motor shaft 167. A free end of the lever 168 is fixed to the second arm 158 by a fixing screw 169. The motor shaft 168 is axially aligned with the aforementioned coupling pin 163. At this time, the upper end portion of the coupling pin 163 is preferably received in the lever 168 as shown in FIG. 29, in order to further stabilize rotation of the lever 168.

The motor shaft 167 of the motor 166, which is reciprocally rotatable in one or the opposite direction, is rotated at a low speed of 1 r.p.m., for example. Such rotation of the motor shaft 167 is transmitted to the second arm 158 through the lever 168 so that the second arm 158 is rotated with respect to the first arm 157, since the body of the motor 166 is fixed to the first arm 157 through the bracket 164. The second arm 158 is rotatable with respect to the first arm 157 between positions shown by solid and phantom lines in FIG. 28.

Microswitches 170 and 171 are adapted to control the stopping of the motor 166, in order to define terminating ends of the motion of the second arm 158. The microswitches 170 and 171 are fixed onto the first arm 157 respectively, so that actuators thereof are brought into contact with the lever 168. The microswitch 170 detects the position of the second arm 158 shown by phantom lines in FIG. 28, to control the stopping of the motor 166. The other microswitch 171 detects the position of the second arm 158 shown by solid lines in FIG. 28, to also control the stopping of the motor 166. The angle of rotation of the motor 166 may be pulse-controlled.

The state of the guide member 104 shown in FIG. 22 corresponds to that provided by the second arm 158 shown by phantom lines in FIG. 28. On the other hand, the state of the guide member 104 shown in FIG. 24 corresponds to that provided by the second arm 158 shown by solid lines in FIG. 28. Therefore, the motor 166 provided in the guide member 104 is rotated in a certain direction, in order to position the bathtub 103 on a side portion of the bottom plate 106 of the bed body 3 as shown in FIG. 22, or a position under the bottom plate 106 of the bed body 3 as shown in FIG. 24.

In order to facilitate the aforementioned movement of the bathtub 103, a plurality of wheels 172 are mounted on the lower portion or frame 110 of the bathtub 103 as shown in FIGS. 23 and 25, for example. These wheels 172 roll on the floor face 24 shown in FIG. 3, for example, on which the bed apparatus 1 is placed.

Description is now made on a method of bathing a sick person or the like using the bed apparatus 1, which has the aforementioned lifting mechanism and the bathtub 103.

In an unused state, the bathtub 103 is vertically contracted and stored in the space 105 under the bed body 3, as shown in FIGS. 2, 24 and 25.

In order to bathe the sick person or the like, the bathtub 103 is brought into the state shown in FIGS. 1, 22 and 23. Namely, in the state shown in FIGS. 2, 24, and 25, the motor 166 provided on the guide member 104 is first driven to expand the internal angle formed by the first and second arms 157 and 158. Thus, the bathtub 103 is moved from the space 105 under the bed body 3 to a prescribed position on the side of the bed body 3.

Then, the motor 143 provided on the bathtub 103 is driven to upwardly move the upper frame 109. Thus, the bathtub body 155 can be expanded to its original configuration as shown in FIGS. 1, 30 and 32.

Then, a prescribed volume of hot water is supplied into the bathtub body 155.

In the lifting mechanism provided on the bed apparatus 1, on the other hand, the sliders 4 and 5 and the upright bars 6 and 7 are brought into the state shown in FIGS. 3 to 5. Further, the plurality of hanger members 61 is inserted under the body of the sick person or the like lying on the bed body 3. The support members 8 and 9 and the side bars 10 and 11 are downwardly moved from the states shown in FIGS. 3 and 5, to positions engageable with the hook portions 62 of the hanger members 61. While the space between the pair of side bars 10 and 11 may be controlled in response to the conformation of the sick person or the like, this space may be controlled only once in an initial stage of employment of the bed apparatus 1.

Upon engagement of the hook portions 62 of the hanger members 61 with the side bars 10 and 11, the support members 8 and 9 and the side bars 10 and 11 are upwardly moved along the upright bars 6 and 7, to separate the hanger members 61 from the mattress 2 which is spread on the bed body 3. Thus, the sick person or the like is raised up from the bed body 3.

A sheet etc. which is spread on the mattress 2 may be exchanged in this state.

When the sick person or the like is raised up from the bed body 3 as described above, the sliders 4 and 5 are made to extend sideways from the bed body 3, as shown in FIGS. 6 and 7. At this time, the sliders 4 and 5 are driven to extend maximally outwardly, to reach a fixed position on the side of the bed body 3. Thus, the sick person or the like is moved to a position immediately above the bathtub 103.

Then, the support members 8 and 9 and the side bars 10 and 11 are downwardly moved. In response to this, the sick person or the like is also downwardly moved on the side of the bed body 3, and brought into the bathtub 103.

After the sick person or the like takes a bath, the plurality of hanger members 61 is again inserted under the body. Then, the vertical positions of the side bars 10 and 11 are so controlled that the hook portions 62 of the hanger members 61 engage with the side bars 10 and 11.

Thereafter, the support members 8 and 9 and the side bars 10, 11 are caused to perform an operation reverse to the above to return the sick person or the like onto the bed body 3.

Further, the hot water is discharged from the bathtub 103.

Then, the bathtub 103 is vertically contracted and again stored in the space 105 under the bed body 3 along the guide members 104, as shown in FIGS. 24 and 25.

Although the present invention has been described with reference to the embodiment shown in the drawings, other modifications are also available within the scope of the present invention.

While the upright bars 6 and 7, which are mounted to upwardly extend from the sliders 4 and 5, are movable along the cross direction of the bed body 3 with respect to the sliders 4 and 5 in the aforementioned bed apparatus 1, for example, such upright bars may alternatively be fixed to the sliders.

While the first and second arms 157 and 158, which are rotatably coupled to each other, are employed in relation to the guide members 104 for the bathtub 103, such arms may be replaced by a combination of telescopically retractable bars, for example. Further, while the motor 167 is adapted to drive each guide member 104, a cylinder may be employed in place of such a motor 167, for example. Alternatively, the guide member 104 may be manually driven by the nurse.

The front and rear crossing links 111 and 112 may be replaced by well-known link mechanisms for vertically expanding and contracting the bathtub 103. Further, the motor 143 may be replaced by a cylinder, for example, for vertically expanding and contracting the bathtub 103. Alternatively, the vertical position of the bathtub 103 may be manually changed by the nurse.

Although the bathtub 103 is vertically collapsible in the aforementioned embodiment, such a bathtub may be so fixed that the same is stored in the space defined under the bottom plate of the bed body while remaining in the vertical position in a used state.

What is claimed is:

1. A bed apparatus comprising a bathtub having a collapsible tub body with an upper tub portion and a lower tub portion, a bed body having a bed bottom plate forming a bed face and leg portions for brining said bed bottom plate into a prescribed horizontal position vertically above a floor face for defining a sidewardly open space between said bed bottom plate and said floor face; said bathtub comprising means for storing said bathtub in said space defined between said bed bottom plate and said floor face; a guide member for coupling said bed body with said bathtub and guiding said bathtub to be movable back and forth between a position under said bed bottom plate and a position on a side of said bed bottom plate, said means for storing said bathtub comprising tub collapsing means including link means comprising diagonally crossing first and second support bars, journal means rotatably coupling said first and second support bars with each other at a crosspoint, first means operatively connecting one end of said first support bar to said upper tub portion, second means operatively connecting the other end of said first support bar to said lower tub portion, third means operatively connecting one end of said second support bar to said upper tub portion, and fourth means operatively connecting the other end of said second support bar to said lower tub portion, whereby said bathtub is vertically collapsible for insertion into said space.

2. The bed apparatus of claim 1, wherein said upper portion of said bathtub comprises an upper frame, wherein said lower tub portion comprises a lower frame provided under said upper frame in parallel thereto, said link means coupling said upper and lower frames to be approachable to each other and separatable from each other; and wherein said collapsible tub body is made of a flexible waterproof sheet material being supported by said upper frame and by said link means.

3. The bed apparatus of claim 2, wherein said fourth means comprise sliding means for slidably securing said other end of said second support bar to said lower frame.

4. The bed apparatus of claim 3, wherein said sliding means comprises an axially rotatable lead screw and a female screw block mounted on said other end of said support bar, said female screw block comprising a female threading cooperating with said lead screw.

5. The bed apparatus of claim 4, further comprising a motor for rotating and driving said lead screw.

6. The bed apparatus of claim 1, wherein said guide member comprises first and second arms (157, 158) and means (163) for rotatably coupling said first and second arms with each other.

7. The bed apparatus of claim 6, further comprising a motor (166) for driving and rotating at least one of said first and second arms.

8. The bed apparatus of claim 1, wherein said bed body comprises a lifting mechanism for carrying a sick person between a position on said bed body and a position on a side of said bed body.

9. The bed apparatus of claim 8, wherein said lifting mechanism comprises: a pair of sliders mounted on both end portions of said bed body along its longitudinal direction to be slidable along the cross direction of said bed body for extending into fixed positions int he cross direction of said bed body upon completion of said sliding movement, a pair of upright bars mounted on respective said sliders so as to upwardly extend from respective said sliders, a pair of support members mounted to be movable along said upright bars and stoppable at moved positions, two parallel side bars for coupling said pair of support members with each other, and a plurality of hanger members for detachably engaging with respective ones of said side bars.

10. The bed apparatus of claim 9, wherein said upright bars are slidable along the cross direction of said bed body relative to said sliders.

* * * * *